US011780192B2

(12) United States Patent
Burstrom et al.

(10) Patent No.: US 11,780,192 B2
(45) Date of Patent: Oct. 10, 2023

(54) PRESSING ARRANGEMENT

(71) Applicant: Quintus Technologies AB, Vasteras (SE)

(72) Inventors: Per Burstrom, Vasteras (SE); Magnus Byggnevi, Vasteras (SE); Stefan Gustafsson, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 681 days.

(21) Appl. No.: 16/612,888

(22) PCT Filed: May 31, 2017

(86) PCT No.: PCT/EP2017/063140
§ 371 (c)(1),
(2) Date: Nov. 12, 2019

(87) PCT Pub. No.: WO2018/219445
PCT Pub. Date: Dec. 6, 2018

(65) Prior Publication Data

US 2020/0156344 A1 May 21, 2020

(51) Int. Cl.

| | |
|---|---|
| ***B30B 11/02*** | (2006.01) |
| ***B30B 11/00*** | (2006.01) |
| ***B22F 3/00*** | (2021.01) |
| ***B22F 3/15*** | (2006.01) |
| ***F27D 7/04*** | (2006.01) |

(52) U.S. Cl.
CPC ..... *B30B 11/002* (2013.01); *B22F 3/003* (2013.01); *B22F 3/15* (2013.01); *F27D 7/04* (2013.01); *B22F 2003/153* (2013.01)

(58) Field of Classification Search
CPC ..... B30B 11/00; B30B 11/002; B30B 15/00; B22F 3/00; B22F 3/02; B22F 3/002; B22F 3/15; B29C 43/10
See application file for complete search history.

(56) References Cited

U.S. PATENT DOCUMENTS

| | | | | |
|---|---|---|---|---|
| 5,792,271 | A | 8/1998 | Fujikawa et al. | |
| 6,514,066 | B1 | 2/2003 | Bergman | |
| 8,573,962 | B2 * | 11/2013 | Yamagata | B01J 3/04 425/405.2 |

FOREIGN PATENT DOCUMENTS

| | | | |
|---|---|---|---|
| CN | 101909789 | | 12/2010 |
| CN | 103402745 | A | 11/2013 |
| CN | 103819202 | A | 5/2014 |
| CN | 203938607 | U | 11/2014 |
| EP | 1004779 | A2 | 5/2000 |

(Continued)

OTHER PUBLICATIONS

Russian Office Action and English translation thereof dated Jun. 8, 2020.

(Continued)

*Primary Examiner* — Thu-Khanh T. Nguyen
(74) *Attorney, Agent, or Firm* — Harness, Dickey & Pierce, P.L.C.

(57) ABSTRACT

A pressing arrangement is disclosed, including a pressure vessel, a pressure medium supplying device configured to output a flow of pressure medium, and a pressure medium accumulator. In an embodiment, the pressure medium accumulator is positioned intermediate the pressure vessel and the pressure medium supplying device.

10 Claims, 1 Drawing Sheet

(56) References Cited

FOREIGN PATENT DOCUMENTS

| | | | |
|---|---|---|---|
| JP | S61161385 | A | 7/1986 |
| JP | H02021190 | A | 1/1990 |
| JP | H02021193 | A | 1/1990 |
| JP | H03013506 | A | 1/1991 |
| JP | 2535408 | | 9/1996 |
| RU | 2350429 | C1 | 3/2009 |
| RU | 2427449 | C1 | 8/2011 |
| RU | 23436657 | | 12/2011 |
| WO | WO-2007/016930 | A1 | 2/2007 |
| WO | WO-2009/076973 | A1 | 6/2009 |
| WO | WO-2012/092961 | A1 | 7/2012 |

OTHER PUBLICATIONS

Russian Search Report and English translation thereof dated Jun. 8, 2020.
"Thermal technology dictionary," Jun. 30, 1991.
Chinese Office Action dated Jun. 16, 2021.
CA Chinese Office Action dated Nov. 19, 2020.
International Search Report PCT/ISA/210 for International Application No. PCT/EP2017/063140 dated Feb. 15, 2018.
Written Opinion of the International Searching Authority PCT/ISA/237 for International Application No. PCT/EP2017/063140 dated Feb. 15, 2018.
International Preliminary Report on Patentability PCT/IPEA/409 for International Application No. PCT/EP2017/063140 dated Sep. 9, 2019.
Written Opinion of International Preliminary Report on Patentability PCT/IPEA/408 for International Application No. PCT/EP2017/063140 dated Sep. 9, 2019.

* cited by examiner

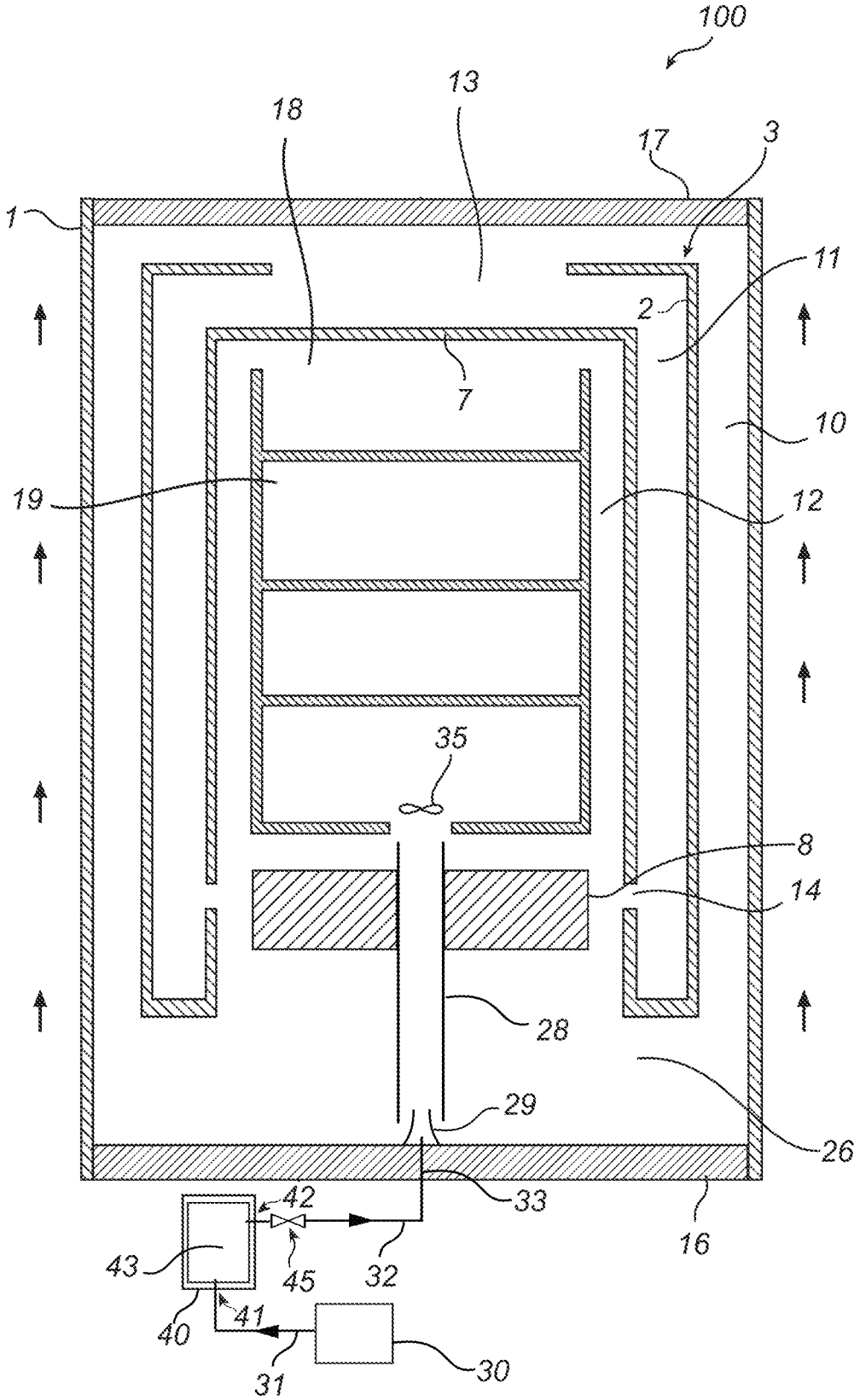
100
13
18
17
3
1
11
2
7
10
19
12
35
8
14
28
29
26
33
42
16
43
45
32
40
41
31
30

PRESSING ARRANGEMENT

CROSS-REFERENCE TO RELATED APPLICATIONS

This patent application is a national phase under 35 U.S. C. § 371 of PCT International Application No. PCT/EP2017/063140 which has an International filing date of May 31, 2017, the entire contents of which is incorporated herein by reference.

TECHNICAL FIELD

The present invention generally relates to the field of pressure treatment. In particular, the present invention relates to a pressing arrangement for treatment of at least one article by means of pressing, for example by means of hot pressing such as hot isostatic pressing (HIP).

BACKGROUND

Hot isostatic pressing (HIP) may for example be used for reducing or even eliminating porosity in castings (e.g., turbine blades) in order to substantially increase their service life and strength (e.g., their fatigue strength). HIP may in addition be used in manufacturing of products by means of compressing powder, which products are desired or required to be fully, or substantially fully, dense, and to have pore-free, or substantially pore-free, outer surfaces, etc.

An article to be subjected to pressure treatment by HIP may be positioned in a load compartment or chamber of a thermally insulated pressure vessel. A treatment cycle may comprise loading the article, treating the article, and unloading the article. Several articles may be treated simultaneously. The treatment cycle may be divided into several parts or phases such as a pressing phase, a heating phase, and a cooling phase. After loading an article into the pressure vessel, it may then be sealed, followed by introduction of a pressure medium (e.g., comprising an inert gas such as Argon-containing gas) into the pressure vessel and the load compartment thereof. The pressure and temperature of the pressure medium is then increased, such that the article is subjected to an increased pressure and an increased temperature during a selected period of time. The increase in temperature of the pressure medium, which in turn may cause an increase in temperature of the article, is provided by means of a heating element or furnace arranged in a furnace chamber of the pressure vessel.

The pressures, temperatures and treatment times may for example depend on the desired or required material properties of the treated article, the particular field of application, and the required quality of the treated article. Pressures in HIP may for example be in the range from 200 bar to 5000 bar, such as from 800 bar to 2000 bar. Temperatures in HIP may for example be in the range from 300° C. to 3000° C., such as from 800° C. to 2000° C.

The pressure vessel may comprise one or more inlets for supply of pressure medium into the pressure vessel, for example from a pressure medium source arranged outside the pressure vessel. The inlets for supply of pressure medium into the pressure vessel may for example be used to introduce pressure medium from a pressure medium supplying device into the pressure vessel prior to the commencing of the treatment cycle, for example in order to at least partly fill the pressure vessel with pressure medium before the treatment cycle begins. As indicated in the foregoing, once the treatment cycle begins, the pressure of the pressure medium may be increased by increasing the pressure in the pressure vessel. In alternative or in addition it may be desired to introduce pressure medium into the pressure vessel during the treatment cycle. The pressure medium that is introduced into the pressure vessel during the treatment cycle may be pressurized, for example by means of a pressure medium supplying device in the form of a compressor.

SUMMARY

Pressure medium supplying devices such as compressors may output a flow of pressure medium that exhibits pulsation. Any such pulsation in the flow of pressure medium that is output from the pressure medium supplying device may cause the flow of pressure medium output from the pressure medium supplying device to exhibit relatively large fluctuations over time. During a period of time when the pressure medium supplying device is operated so as to output a flow of pressurized pressure medium, there may hence be relatively large fluctuations in the flow of pressure medium output from the pressure medium supplying device with respect to a mean value of the pressure medium flow over that period of time. For example, during that period of time, there may be relatively high instantaneous values of the mass of pressure medium per unit volume and per unit time output from the pressure medium supplying device as compared to a mean value of the mass of pressure medium per unit volume output from the pressure medium supplying device taken over that period of time.

In some circumstances and/or applications it may however be desired or even required to be able to ensure that a flow of pressure medium from a pressure medium supplying device that is input into the pressure vessel (e.g., during a treatment cycle) exhibits only relatively small or even (substantially) no fluctuations over time with respect to an average flow level. In other words, it may be desired or even required to ensure that the flow of pressure medium from the pressure medium supplying device that is input into the pressure vessel is relatively steady, or even, over time.

In view of the above, a concern of the present invention is to provide a pressing arrangement, comprising a pressure vessel and a pressure medium supplying device configured to output a flow of pressure medium, which pressing arrangement facilitates or enables for achieving a flow of pressure medium that is input into the pressure vessel (e.g., during a treatment cycle) which exhibits relatively small or no (or substantially no) fluctuations over time with respect to an average flow level.

To address at least one of this concern and other concerns, a pressing arrangement in accordance with the independent claim is provided. Preferred embodiments are defined by the dependent claims.

According to a first aspect, there is provided a pressing arrangement. The pressing arrangement, which comprises a pressure vessel and a pressure medium supplying device which is configured to output a flow of pressure medium. The pressing arrangement comprises a pressure medium accumulator. The pressure medium accumulator comprises at least one inlet in fluid communication with the pressure medium supplying device for receiving the flow of pressure medium output by the pressure medium supplying device. The pressure medium accumulator comprises at least one outlet in fluid communication with the pressure vessel for outputting a flow of pressure medium to the pressure vessel. The pressure medium accumulator comprises at least one internal space or cavity in fluid communication with the at least one inlet and the at least one outlet, respectively. The pressure medium accumulator is configured to continuously or continually accumulate pressure medium received via the at least one inlet within the at least one internal space, wherein accumulated amounts of pressure medium are continuously or continually output from the at least one internal space via the at least one outlet such that the pressure medium accumulator outputs a flow of pressure medium via the at least one inlet to the pressure vessel.

Thus, the pressure medium accumulator is positioned intermediate the pressure medium supplying device and the pressure vessel. In other words, the pressure medium accumulator is arranged at an intermediate position in the flow path for the pressure medium between the pressure medium supplying device and the pressure vessel, such that at least a portion of any pressure medium that is output by the pressure medium supplying device is conveyed to the pressure vessel via the pressure medium accumulator.

By means of the continuous or continual accumulation of pressure medium received at the pressure medium accumulator from the pressure medium supplying device in the at least one internal space or cavity of the pressure medium accumulator, and by the continuous or continual output of accumulated amounts of pressure medium from the pressure medium accumulator, a flow of pressure medium from the pressure medium accumulator (and consequently to the pressure vessel) may be achieved, which exhibits relatively small, or even no (or substantially no) fluctuations over time as compared to an average flow level of the pressure medium flow. Any occurrence of pulsation in the flow of pressure medium output from the pressure medium supplying device may thereby, by means of the pressure medium accumulator positioned intermediate the pressure vessel and the pressure medium supplying device, be reduced, or possibly even eliminated. During a period of time when the pressure medium supplying device is operated so as to output a flow of pressurized pressure medium, there may be relatively small instantaneous values of the mass of pressure medium per unit volume and unit period of time in the pressure medium flow as compared to the mean value of the mass of pressure medium per unit volume in the pressure medium flow taken over that period of time. Thus, by way of the pressure medium accumulator positioned intermediate between the pressure medium supplying device and the pressure vessel, it may be facilitated or enabled to achieve a steadier—or more even—flow of pressure medium into the pressure vessel, as compared to if the pressure medium supplying device would be directly connected to the pressure vessel and pressure medium output by the pressure medium supplying device would be directly fed into the pressure vessel without passing the pressure medium accumulator.

The pressure medium accumulator may for example be configured or arranged such that the at least one internal space or cavity has a volume per unit length of the pressure medium flow path through the pressure medium accumulator that exceeds the volume per unit length of a pressure medium flow path between the pressure medium accumulator and the pressure vessel and/or between the pressure medium accumulator and the pressure medium supplying device (e.g., the volume per unit length within a pressure medium conduit between the pressure medium accumulator and the pressure vessel and/or between the pressure medium accumulator and the pressure medium supplying device). The pressure medium accumulator may be configured or arranged such that the ratio between the volume per unit length of the pressure medium flow path through the pressure medium accumulator and the volume per unit length of a pressure medium flow path between the pressure medium accumulator and the pressure vessel and/or between the pressure medium accumulator and the pressure medium supplying device exceeds a selected value.

The internal space or cavity of the pressure medium accumulator may be an enclosed space or cavity for accommodating pressure medium therein.

The pressure medium accumulator may for example comprise a pressure medium accumulating pressure vessel arranged for accommodating pressure medium therein.

The pressure medium accumulating pressure vessel may be arranged with a smaller internal volume than the pressure vessel mentioned in the foregoing included in the pressing arrangement and which is in fluid communication with the pressure medium accumulator. The pressure medium accumulating pressure vessel may for example comprise or be constituted by a so called mono block pressure vessel, i.e., a pressure vessel with relatively thick walls for withstanding relatively high pressure within the pressure vessel, and/or a pre-stressed pressure vessel which has relatively thin walls and radial and/or axial pre-stressing means provided on the envelope surface of the pressure vessel for accommodating radial and/or axial forces exerted on the pressure vessel due to a relatively high pressure within the pressure vessel. The radial pre-stressing means may for example comprise wires (e.g., made of steel) wound in a plurality of turns so as to form one or more bands, and preferably in several layers, around an envelope surface of the pressure medium accumulating pressure vessel (or a pressure cylinder thereof). In alternative or in addition the pressure medium accumulator may for example comprise piping or tubing, e.g., high pressure piping or tubing, possibly arranged so as to exhibit a plurality of bends such as to form a zig zag or meandering piping or tubing.

As will be further described in the following, the pressure medium supplying device may for example comprise at least one compressor, which may be configured to output a pressurized flow of pressure medium.

In the context of the present application, by means of the continuous or continual accumulation of pressure medium received by the pressure medium accumulator in the at least one internal space or cavity of the pressure medium accumulator, it is meant that pressure medium received by the pressure medium accumulator is momentarily stored in the at least one internal space or cavity, for example by means of a bladder, piston and/or (elastic) diaphragm based device of the pressure medium accumulator, and which momentary storing of pressure medium is carried out continuously or continually, for example while increasing amounts of pressure medium output from the pressure medium supplying device are received by the pressure medium accumulator.

The pressing arrangement may comprise at least one pressure medium guiding passage configured to permit passage of pressure medium. The pressure vessel and the pressure medium supplying device may be in fluid communication with each other by means of the at least one pressure medium guiding passage. The pressure medium accumulator may be at least in part constituted by an enclosed space of a part or portion of the at least one pressure medium guiding passage.

The at least one pressure medium guiding passage may be arranged so as to permit for a flow of pressure medium (e.g., from the pressure medium supplying device) into the pressure vessel and possibly also so as to permit for a flow of pressure medium out of the pressure vessel. The pressure medium accumulator may be at least in part constituted by a part or portion of the at least one pressure medium guiding passage. The pressure medium accumulator may for example be arranged in, or be a part or portion of, the at least one pressure medium guiding passage. The at least one pressure medium guiding passage may for example comprise tubing or piping. Thus, the at least one internal space or cavity of the pressure medium accumulator may for example be realized by means of an enclosed space within tubing or piping interconnecting the pressure vessel and the pressure medium supplying device. In alternative or in addition, the pressure medium accumulator, or the at least one internal space or cavity of the pressure medium accumulator, may comprise or be constituted by at least one tank or reservoir.

The pressure vessel may comprise at least one flow generator. The at least one flow generator may for example comprise an ejector.

The pressure vessel may comprise at least one pressure medium conduit, which may have an inlet in fluid communication with the pressure medium accumulator for receiving the pressure medium flow output from the pressure medium accumulator, and an outlet in fluid communication with the at least one flow generator, such that the pressure medium flow output from the pressure medium accumulator is input into the at least one flow generator. Thus, the pressure medium flow output from the pressure medium accumulator may drive at least one flow generator that may be arranged in the pressure vessel.

The pressure vessel may comprise a furnace chamber. The furnace chamber may comprise a furnace, or heater or heating elements, for heating of the pressure medium in the pressure vessel for example during a pressing phase of a treatment cycle. Inside the furnace chamber there may be a load compartment for accommodating at least one article to be treated by hot pressing, such as hot isostatic pressing. The load compartment may be arranged so as to allow for a flow of pressure medium through the load compartment (e.g., by means of the load compartment being provided with a lower opening and an upper opening). The at least one flow generator, which as mentioned in the foregoing for example may comprise an ejector, may be used to input a flow of relatively cool pressure medium into the furnace chamber, and hence also the load compartment, for cooling of the at least one article during a cooling phase of a treatment cycle. The at least one flow generator may for example comprise, or be coupled to, at least one pressure medium distribution conduit. The at least one flow generator may be coupled to the at least one pressure medium distribution conduit for example via a pressure medium conduit, which at one end may be coupled to the at least one flow generator, and at the other end may be coupled to the at least one pressure medium distribution conduit. The pressure medium output from the at least one flow generator may be discharged into the furnace chamber by means of the at least one pressure medium distribution conduit. The at least one pressure medium distribution conduit may be referred to as, and/or comprise, a diffusor or a pressure medium mixing conduit. In the event that the ejector for some reason would fail or malfunction such that its pressure medium discharging capacity or capability deteriorates or even such that the ejector in rendered inoperable, the cooling of the at least one article during a cooling phase of a treatment cycle may become slower and/or less effective. In previous pressing arrangements, the ejector is generally constructed or designed such that it should be able to withstand an expected maximum instantaneous value of mass of pressure medium per unit volume and unit period of time of the pressure medium flow that is input into the ejector. The maximum instantaneous value of the flow is generally quite larger than the mean value of the flow. In case an instantaneous value of the mass of pressure medium per unit volume and unit period of time in the pressure medium flow that is input into the ejector would exceed the expected maximum instantaneous value which the ejector is constructed or designed for, the ejector may malfunction or be rendered inoperable. As indicated in the foregoing, by way of the pressure medium accumulator positioned intermediate between the pressure medium supplying device and the pressure vessel, the instantaneous values of the flow of pressure medium input into the pressure vessel—including the maximum instantaneous value—may be relatively close to the mean value of the flow of pressure medium flow input into the pressure vessel taken over some period of time. That is to say, the instantaneous values may deviate relatively little from the mean value. This means that the requirement of the at least one flow generator, e.g., an ejector, to withstand very high expected maximum instantaneous values of the mass of pressure medium per unit volume and unit period of time in the pressure medium flow that is input into the at least one flow generator may be mitigated (given a desired mean value of the mass of pressure medium per unit volume). In turn, this may reduce the cost of the at least one flow generator. Also, by being able to provide a flow of pressure medium input into the at least one flow generator that exhibits relatively small fluctuations over time as compared to an average flow level, the average flow level of the flow of pressure medium input into the at least one flow generator may be increased while still keeping a relatively low maximum instantaneous value of the pressure medium flow. By increasing the average flow level of the flow of pressure medium input into the at least one flow generator the cooling rate may be increased.

Also, by being able to provide a flow of pressure medium input into the at least one flow generator that exhibits relatively small fluctuations over time as compared to an average flow level—and which flow of pressure medium subsequently may be discharged into the furnace chamber, and hence also the load compartment, the service life of the furnace chamber may be increased. Furthermore, the cooling of the pressure medium within the furnace chamber may exhibit a relatively high degree of spatial uniformity throughout the furnace chamber. And the drop in pressure of the pressure medium while passing through the furnace chamber and/or the load compartment may be kept relatively small. Also, the risk of any buckling of furnace chamber occurring may be reduced or even eliminated.

The pressing arrangement may comprise a press (e.g., a press configured to carry out HIP), in which the pressure vessel may be comprised. At least one of the pressure medium supplying device and the pressure medium accumulator may be arranged separately from the press. For example, the pressure medium supplying device and/or the pressure medium accumulator may be arranged externally with respect to the press, or outside the press.

The pressure medium supplying device may be configured to output a flow of gaseous pressure medium. The gaseous pressure medium may for example comprise an inert gas, such as, for example, an Argon-containing gas, or Argon gas.

The pressure medium supplying device may for example comprise at least one compressor, which may be arranged to compress pressure medium and output a flow of pressurized pressure medium. The pressure medium supplying device may for example comprise a plurality of compressors, which for example may be arranged in parallel.

The pressure medium accumulator may be arranged such that the at least one internal space has a volume that is at least as large as a predefined constant (dimensionless) multiplied with the volume of a compression stage of the at least one compressor, from which compression stage compressed gaseous pressure medium exits the at least one compressor. The predefined constant may for example be 3 or higher, for example 3.5 or higher, or 4 or higher.

Generally, the larger the volume of the internal space of the pressure medium accumulator, the smaller the fluctuations over time will be in a flow of pressure medium from the pressure medium accumulator as compared to an average flow level of the pressure medium flow. However, the inventors have by means of fluid flow simulations found that by choosing a volume of the internal space of the pressure medium accumulator to be at least the volume of a compression stage of the at least one compressor multiplied with 3 or higher, or 3.5 or higher, or 4 or higher, a flow of pressure medium from the pressure medium accumulator (and consequently to the pressure vessel) may be achieved that will only exhibit relatively small or even no (or substantially no) fluctuations over time as compared to an average flow level of the pressure medium flow.

The pressure medium supplying device may comprise at least one pressure medium source. The at least one pressure medium source may for example comprise or be constituted by one or more tanks or reservoirs for pressure medium.

The pressing arrangement may comprise pressure medium flow regulating means. The pressure medium flow regulating means may have at least one inlet in fluid communication with the pressure medium accumulator, and at least one outlet in fluid communication with the pressure vessel. The pressure medium flow regulating means may be configured to control the flow of pressure medium from the pressure medium accumulator to the pressure vessel.

Thus, the pressure medium flow regulating means may be positioned intermediate the pressure medium accumulator and the pressure vessel. The pressure medium flow regulating means may for example be configured to control the flow of pressure medium from the pressure medium accumulator to the pressure vessel with respect to the mass of fluid pressure medium per unit volume and unit period of time passing through the pressure medium flow regulating means. The pressure medium flow regulating means may for example comprise one or more valves—or more generally, controllable pressure medium flow restrictions—for controllably preventing or at least impeding the flow of pressure medium from the pressure medium accumulator to the pressure vessel, or for controllably permitting flow of pressure medium from the pressure medium accumulator to the pressure vessel. The pressure medium flow regulating means may for example be configured to pre-pressurize the flow of pressure medium exiting the pressure medium accumulator, prior to the flow of pressure medium being input into the pressure vessel. By restricting or even preventing pressure medium flow through the pressure medium flow regulating means, an increased amount of pressure medium may become accumulated within the at least one internal space of the pressure medium accumulator.

The pressure medium accumulator may be a passive device, wherein by means of the volume of the at least one internal space or cavity of the pressure medium accumulator, pressure medium received at the pressure medium accumulator is momentarily stored therein, thereby continuously or continually accumulating pressure medium received at the pressure medium accumulator, and accumulated amounts of pressure medium is continuously or continually output from the at least one outlet of the pressure medium accumulator so as to cause the pressure medium accumulator to output a flow of pressure medium to the pressure vessel. In alternative, the pressure medium accumulator may be an active device. For example, the pressure medium accumulator (and/or a sensor coupled to or comprised in the pressure medium accumulator) may be configured to sense the amount of pressure medium accumulated in the at least one internal space or cavity of the pressure medium accumulator (or to receive an indication of the amount of pressure medium accumulated in the at least one internal space or cavity of the pressure medium accumulator, for example from a sensor configured to sense that quantity). Once the amount of pressure medium accumulated in the at least one internal space or cavity of the pressure medium accumulator has reached a selected value, the accumulated pressure medium may be caused to be discharged from the pressure medium accumulator, for example by means of operation of a valve or any other type of adjustable throttle or pressure medium flow restriction means. According to another example, the pressure medium accumulator (and/or a sensor coupled to or comprised in the pressure medium accumulator) may be configured to sense the pressure in the at least one internal space or cavity of the pressure medium accumulator (or to receive an indication of pressure in the at least one internal space or cavity of the pressure medium accumulator, for example from a sensor configured to sense the pressure). Once the pressure in the at least one internal space or cavity of the pressure medium accumulator exceeds a threshold value (e.g., a selected pressure level above a pressure level in the pressure vessel), the accumulated pressure medium may be caused to be discharged from the pressure medium accumulator.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWING

Exemplifying embodiments of the present invention will be described below with reference to the accompanying drawing.

FIG. 1 a schematic, in part sectional, side view of a pressing arrangement according to an embodiment of the present invention.

The figure is schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawing, in which exemplifying embodiments of the present invention are illustrated. The present invention may, however, be embodied in many different forms and should not be construed as limited to the embodiments of the present invention set forth herein; rather, these embodiments are provided by way of example so that this disclosure will convey the scope of the present invention to those skilled in the art.

FIG. 1 is a schematic, in part sectional, side view of a pressing arrangement 100 according to an embodiment of the present invention. The pressing arrangement 100 is arranged for treatment of at least one article by means of pressing, for example by means of hot pressing such as hot isostatic pressing (HIP).

The pressing arrangement 100 comprises a pressure vessel, which comprises a pressure cylinder 1 and a top end closure 17 and a bottom end closure 16. It is to be understood that the pressure vessel—which will be collectively referred to in the following by way of the reference numerals 1, 16 and 17—may comprise additional parts, components or elements not illustrated in FIG. 1.

The pressing arrangement 100 comprises a pressure medium supplying device, schematically indicated by the element 30 in FIG. 1, which is configured to output a flow of pressure medium. For example—and in accordance with the embodiment of the present invention illustrated in FIG. 1—the pressure medium supplying device 30 may for example comprise at least one compressor, which may be configured to output a pressurized flow of pressure medium. The pressure medium supplying device 30 may—in addition or in alternative—comprise at least one pressure medium source (e.g., comprising a tank or reservoir of pressure medium).

The pressing arrangement 100 comprises a pressure medium accumulator, schematically indicated by the element 40 in FIG. 1. The pressure medium accumulator 40 comprises an inlet 41, which is in fluid communication with the pressure medium supplying device 30 for receiving the flow of pressure medium output by the pressure medium supplying device 30, and an outlet 42, which is in fluid communication with the pressure vessel 1, 16, 17 for outputting a flow of pressure medium to the pressure vessel 1, 16, 17. It is to be understood that the pressure medium accumulator 40 in accordance with one or more embodiments of the present invention could comprise more than one inlet and/or more than one outlet. The pressure medium accumulator 40 may for example comprise at least one tank or reservoir.

The pressure medium accumulator 40 comprises an internal space 43, which is in fluid communication with the inlet 41 and with the outlet 42, respectively. In accordance with one or more embodiments of the present invention, the pressure medium accumulator 40 could comprise several internal spaces, which possibly may be interconnected with each other. According to another example, each internal space may be in fluid communication with at least one inlet and at least one outlet, respectively, which may correspond to the internal space. Thus, each internal space could have (possibly dedicated) respective inlet(s) and outlet(s) associated therewith.

The pressure medium accumulator 40 is configured to continuously or continually accumulate pressure medium received via the inlet 41 within the internal space 43 of the pressure medium accumulator 40, wherein accumulated amounts of pressure medium are continuously or continually output from the internal space 43 via the outlet 42 such that the pressure medium accumulator 40 outputs a flow of pressure medium via the inlet 41 to the pressure vessel 1, 16, 17.

As illustrated in FIG. 1, the pressing arrangement 100 comprises pressure medium guiding passages 31 and 32 configured to permit passage of pressure medium between the pressure medium supplying device 30 and the pressure medium accumulator 40 and between the pressure medium accumulator 40 and the pressure vessel 1, 16, 17, respectively. Thus, the pressure vessel 1, 16, 17 and the pressure medium supplying device 30 are in fluid communication with each other by means of the pressure medium guiding passages 31 and 32 and the pressure medium accumulator 40.

In accordance with the embodiment of the present invention illustrated in FIG. 1, the pressing arrangement 100 comprises pressure medium flow regulating means 45 for example in the form of one or more valves, as illustrated in FIG. 1, which may be positioned intermediate the pressure medium accumulator 40 and the pressure vessel 1, 16, 17, in the pressure medium guiding passage 32. As further illustrated in FIG. 1, the pressure medium flow regulating means 45 may have an inlet in fluid communication with the pressure medium accumulator 40 and an outlet in fluid communication with the pressure vessel 1, 16, 17. The pressure medium flow regulating means 45 may be configured to control the flow of pressure medium from the pressure medium accumulator 40 to the pressure vessel 1, 16, 17.

For example—and in accordance with the embodiment of the present invention illustrated in FIG. 1—the pressure vessel 1, 16, 17 may comprise a flow generator 29. The pressure vessel 1, 16, 17 comprises a pressure medium conduit 33, which has an inlet in fluid communication with the pressure medium accumulator 40 for receiving the pressure medium flow output from the pressure medium accumulator 40, and an outlet in fluid communication with the flow generator 29 such that the pressure medium flow output from the pressure medium accumulator 40 is input into the flow generator 29. The flow generator 29 for example may comprise an ejector 29 (or several ejectors), but could in alternative or in addition comprise one or more fans or pumps or the like. The flow generator 29 will be further described in the following in connection with the description of other elements and components which may be comprised in the pressure vessel 1, 16, 17 and which are illustrated in FIG. 1 for exemplifying purposes.

The pressure vessel 1, 16, 17 may be comprised in a press, such as, for example, a HIP device as indicated in the foregoing. As indicated in FIG. 1, the pressure medium supplying device 30 and the pressure medium accumulator 40 may both be arranged separately from the press while being in fluid communication with the press, and particularly with the pressure vessel 1, 16, 17 thereof. However, the pressure medium supplying device 30 and/or the pressure medium accumulator 40 could according to other examples be arranged in the press such that it or they are not arranged separately from the press, e.g., such that the pressure medium supplying device 30 and/or the pressure medium accumulator 40 are mechanically connected to the press.

As per the embodiment of the present invention illustrated in FIG. 1, the pressure vessel 1, 16, 17 comprises a furnace chamber 18. The furnace chamber 18 may comprise a furnace, or heater or heating elements, for heating of the pressure medium in the pressure vessel for example during a pressing phase of a treatment cycle. The furnace is not shown in FIG. 1. The furnace could for example be arranged at a lower portion of the furnace chamber 18 and/or in proximity to the inner side, or lateral, surfaces of the furnace chamber 18. It is to be understood that different configurations and arrangements of the furnace in relation to, e.g., within, the furnace chamber 18 are possible. Any implementation of the furnace with regard to arrangement thereof in relation to, e.g., within, the furnace chamber 18 may be used in any one of the embodiments of the present invention described herein. In the context of the present application, the term "furnace" refers to the elements or means for providing heating, while the term "furnace chamber" refers to the area or region in which the furnace and possibly the load compartment and any article are located. As illustrated in FIG. 1, the furnace chamber 18 may not occupy the whole inner space of the pressure vessel 1, 16, 17, but may leave an intermediate space 10 of the interior of the pressure vessel 1, 16, 17 around the furnace chamber 18. The intermediate space 10 forms a pressure medium guiding passage 10. During operation of the pressing arrangement 100, the temperature in the intermediate space 10 may be lower than the temperature in the furnace chamber 18, but the intermediate space 10 and the furnace chamber 18 may be at equal, or substantially equal, pressure.

The outer surface of the outer walls of the pressure vessel 1, 16, 17 may be provided with channels, conduits or tubes, etc. (not shown), which channels, conduits or tubes for example may be arranged so as to be in connection with the outer surface of the outer wall of the pressure vessel 1, 16, 17 and may be arranged to run parallel to an axial direction of the pressure vessel 1, 16, 17. A coolant for cooling of the walls of the pressure vessel 1, 16, 17 may be provided in the channels, conduits or tubes, whereby the walls of the pressure vessel 1, 16, 17 may be cooled in order to protect the walls from detrimental heat building up during operation of the pressure vessel 1, 16, 17. The coolant in the channels, conduits or tubes may for example comprise water, but another or other types of coolants are possible. An exemplifying flow of coolant in channels, conduits or tubes provided on the outer surface of the outer walls of the pressure vessel 1, 16, 17 is indicated in FIG. 1 by the arrows on the outside of the pressure vessel 1, 16, 17.

On the outside surface of the outer walls of the pressure cylinder 1, and possibly on any channels, conduits and/or tubes, etc. for coolant as described it the foregoing, pre-stressing means may be provided. The pre-stressing means (not shown in FIG. 1) may for example be provided in the form of wires (e.g., made of steel) wound in a plurality of turns so as to form one or more bands, and preferably in several layers, around the outside surface of the outer walls of the pressure cylinder 1 and possibly also any channels, conduits and/or tubes, etc. for coolant that may be provided thereon. The pre-stressing means may be arranged for exerting radial compressive forces on the pressure cylinder 1.

Even though it is not explicitly indicated in any of the figures, the pressure vessel 1, 16, 17 may be arranged such that it can be opened and closed, such that any article within the pressure vessel 1, 16, 17 may be inserted or removed. An arrangement of the pressure vessel 1, 16, 17 such that it can be opened and closed may be realized in a number of different manners, as known in the art. Although not explicitly indicated in FIG. 1, one or both of the top end closure 17 and the bottom end closure 16 may be arranged so that it or they can be opened and closed.

The furnace chamber 18 is enclosed by a heat insulated casing 3 and is arranged so that pressure medium can enter and exit the furnace chamber 18. In accordance with the embodiment of the present invention illustrated in FIG. 1, the heat insulated casing 3 comprises a heat insulating portion 7, a housing 2 which is partly enclosing the heat insulating portion 7, and a bottom insulating portion 8. Not all of the elements of the heat insulated casing 3 may be arranged so as to be heat insulated or heat insulating. For example, the housing 2 may not necessarily be arranged so as to be heat insulated or heat insulating.

The pressure medium used in the pressure vessel 1, 16, 17 or pressing arrangement 100 may for example comprise or be constituted by a liquid or gaseous medium which may have a relatively low chemical affinity in relation to the article(s) to be treated in the pressure vessel 1, 16, 17. The pressure medium may for example comprise a gas, for example an inert gas such as Argon gas.

As indicated in FIG. 1, the pressure medium may exit the load compartment 19 at the top portion thereof and subsequently be guided in a pressure medium guiding passage 12 between the walls of the load compartment 19 and the heat insulating portion 7, after which the pressure medium may enter into the pressure medium guiding passage 11 by way of openings 14 between the heat insulating portion 7 and the housing 2. The openings 14 between the heat insulating portion 7 and the housing 2 may possibly be provided with valves or any other type of adjustable throttle or pressure medium flow restriction means.

The pressure medium that enters into the pressure medium guiding passage 11 by way of the openings 14 between the heat insulating portion 7 and the housing 2 is guided in the pressure medium guiding passage 11 towards the top end closure 17 where it may exit the pressure medium guiding passage 11 and the heat insulated casing 3 by way of an opening 13 in the housing 2, as illustrated in FIG. 1.

A pressure medium guiding passage defined by the space in part defined by the inner surface of the top end closure 17 and the pressure medium guiding passage 10 are arranged to guide the pressure medium having exited the opening 13 in the housing 2 in proximity to the top end closure 17 and in proximity to an inner surface of walls of the pressure vessel 1, 16, 17 (e.g., the walls of the pressure cylinder 1, respectively, as illustrated in FIG. 1) before the pressure medium re-enters into the furnace chamber 18. Thereby, an outer cooling loop may be formed by at least the pressure medium guiding passage 10 and the pressure medium guiding passage 11. In a part of the outer cooling loop, the pressure medium is guided in proximity to the inner surface of the top end closure 17 and the inner surface of walls of the pressure cylinder 1. The amount of thermal energy which may be transferred from the pressure medium during its passage in proximity to inner surfaces of the top end closure 17 and the inner surface of walls of the pressure cylinder 1 may depend on at least one of the following: the speed of the pressure medium, the amount of pressure medium having (direct) contact with the inner surface of the top end closure 17 and the inner surface of walls of the pressure cylinder 1, the relative temperature difference between the pressure medium and the inner surface of the top end closure 17 and the inner surface of walls of the pressure cylinder 1, the thickness of the top end closure 17 and the thickness of the pressure cylinder 1, and the temperature of any flow of coolant in channels, conduits or tubes provided on the outer surface of walls of the pressure cylinder 1 (indicated in FIG. 1 by the arrows on the outside of the pressure cylinder 1).

The pressure medium that is guided in the pressure medium guiding passage 10 back towards the furnace chamber 18 enters a space 26 between the furnace chamber 18—or the bottom insulating portion 8—and the bottom end closure 16. The furnace chamber 18 may be arranged so that pressure medium can enter the furnace chamber 18 from, and exit the furnace chamber 18 into, the space 26. For example, and in accordance with the embodiment of the present invention illustrated in FIG. 1, the furnace chamber 18 may be provided with an opening in the bottom insulating portion 8 permitting pressure medium flow into or out of the furnace chamber 18. As illustrated in FIG. 1, the pressing arrangement 100 may comprise a fan 35 or the like for circulation of pressure medium within the furnace chamber 18. In accordance with the embodiment of the present invention illustrated in FIG. 1, the fan 35 may for example be arranged at an opening in the load compartment 19 above the bottom insulating portion 8 which permits pressure medium flow into or out of the load compartment 19.

As illustrated in FIG. 1, there may be provided a pressure medium conduit 28 (e.g., comprising a transport pipe) which may extend from the space 26 between the bottom insulating portion 8 and the bottom end closure 16, and through the bottom insulating portion 8, so that pressure medium from the pressure medium guiding passage 10 which enters into the space 26 can be guided via the pressure medium conduit 28 into the furnace chamber 18.

Possibly, the pressure medium conduit 28 could extend into the load compartment 19, possibly beyond the fan 35, such that the outlet of the pressure medium conduit 28 is located within the load compartment 19. The pressure medium conduit 28 could possibly be provided with one or more openings (not shown in FIG. 1), which possibly may include one or more adjustable throttles such as valves, permitting flow of pressure medium into the pressure medium conduit 28. Pressure medium which enters into the space 26 between the bottom insulating portion 8 and the bottom end closure 16 after having been guided in the pressure medium guiding passage 10 may be guided towards and into the pressure chamber 18 via the pressure medium conduit 28. This transport of pressure medium via the pressure medium conduit 28 may be in addition to the pressure medium flow output from the pressure medium accumulator 40 which is input into the flow generator 29 via the outlet of the pressure medium conduit 33 of the pressure vessel 1, 16, 17, such as described in the foregoing.

In conclusion, a pressing arrangement is disclosed, comprising a pressure vessel, a pressure medium supplying device configured to output a flow of pressure medium, and a pressure medium accumulator which is positioned intermediate the pressure vessel and the pressure medium supplying device.

While the present invention has been illustrated in the appended drawing and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawing, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A pressing arrangement comprising:

a pressure vessel;

a pressure medium supplying device configured to output a flow of a pressure medium; and a pressure medium accumulator comprising:

at least one inlet in fluid communication with the pressure medium supplying device for receiving the flow of the pressure medium that is output by the pressure medium supplying device;

at least one outlet in fluid communication with the pressure vessel for outputting a flow of the pressure medium to the pressure vessel; and at least one internal space in fluid communication with the at least one inlet and the at least one outlet, respectively;

wherein the pressure medium accumulator is configured to continuously or continually accumulate the pressure medium received via the at least one inlet within the at least one internal space, such that accumulated amounts of the pressure medium are continuously or continually output from the at least one internal space via the at least one outlet such that the pressure medium accumulator outputs the flow of the pressure medium via the at least one outlet to the pressure vessel;

wherein the pressure medium supplying device is configured to output a flow of gaseous pressure medium, and wherein the pressure medium supplying device comprises at least one compressor;

wherein the pressure medium accumulator is arranged such that the at least one internal space has a volume that is at least as large as a predefined constant multiplied with a volume of a compression stage of the at least one compressor, wherein from the compression stage, a compressed gaseous pressure medium exits the at least one compressor, wherein the predefined constant has a value that is equal to or greater than 3.

2. A pressing arrangement according to claim 1, comprising at least one pressure medium guiding passage configured to permit passage of the pressure medium, wherein the pressure vessel and the pressure medium supplying device are in fluid communication with each other by means of the at least one pressure medium guiding passage, and wherein the pressure medium accumulator is at least in part constituted by an enclosed space of a part or portion of the at least one pressure medium guiding passage.

3. A pressing arrangement according to claim 1, wherein the pressure medium accumulator comprises at least one tank or reservoir.

4. A pressing arrangement according to claim 1, wherein the pressure vessel comprises at least one flow generator, and wherein the pressure vessel comprises at least one pressure medium conduit having an inlet in fluid communication with the pressure medium accumulator for receiving the flow of the pressure medium that is output from the pressure medium accumulator and an outlet in fluid communication with the at least one flow generator such that the flow of the pressure medium that is output from the pressure medium accumulator is input into the at least one flow generator.

5. A pressing arrangement according to claim 4, wherein the at least one flow generator comprises an ejector.

6. A pressing arrangement according to claim 1, comprising a press, wherein the pressure vessel is comprised in the press, wherein at least one of the pressure medium supplying device and the pressure medium accumulator is arranged separately from the press.

7. A pressing arrangement according to claim 1, wherein the pressure medium supplying device comprises a plurality of compressors arranged in parallel.

8. A pressing arrangement according to claim 1, wherein the value of the predefined constant is equal to or greater than 3.5, or is equal to or greater than 4.

9. A pressing arrangement according to claim 1, wherein the pressure medium supplying device comprises at least one pressure medium source.

10. A pressing arrangement according to claim 1, further comprising a pressure medium flow regulating means having at least one inlet in fluid communication with the pressure medium accumulator and at least one outlet in fluid communication with the pressure vessel, wherein the pressure medium flow regulating means is configured to control the flow of pressure medium from the pressure medium accumulator to the pressure vessel.

* * * * *